US006719262B2

(12) United States Patent
Whitby et al.

(10) Patent No.: US 6,719,262 B2
(45) Date of Patent: Apr. 13, 2004

(54) BIDIRECTIONAL SEALING BLOWOUT PREVENTER

(75) Inventors: Melvyn F. Whitby, Houston, TX (US); Paul L. Tasson, Houston, TX (US); Bolie C. Williams, Houston, TX (US)

(73) Assignee: Cooper Cameron Corporation, Houston, TX (US)

( * ) Notice: Subject to any disclaimer, the term of this patent is extended or adjusted under 35 U.S.C. 154(b) by 91 days.

(21) Appl. No.: 09/923,209

(22) Filed: Aug. 6, 2001

(65) Prior Publication Data

US 2003/0024705 A1 Feb. 6, 2003

(51) Int. Cl.[7] ..... E21B 33/06
(52) U.S. Cl. ..... 251/1.3; 166/85.4
(58) Field of Search ..... 251/1.3, 1.1; 166/85.4

(56) References Cited

U.S. PATENT DOCUMENTS 1,836,506 A * 12/1931 Rasmussen et al. ..... 251/1.3
3,946,806 A 3/1976 Meynier, III
4,043,389 A 8/1977 Cobb
4,132,267 A 1/1979 Jones
4,249,458 A 2/1981 Massing
4,313,496 A 2/1982 Childs et al.
4,413,642 A * 11/1983 Smith et al. ..... 251/1.1
4,492,359 A 1/1985 Baugh
4,504,037 A 3/1985 Beam et al.
4,538,506 A 9/1985 Mattsson
4,583,569 A * 4/1986 Ahlstone ..... 251/1.3
4,655,431 A * 4/1987 Helfer et al. ..... 251/1.3
5,067,323 A 11/1991 Bennett et al.
5,205,200 A 4/1993 Wright
5,294,088 A * 3/1994 McWhorter et al. ..... 251/1.3
5,320,325 A 6/1994 Young et al.
5,575,452 A 11/1996 Whitby et al.
5,653,418 A 8/1997 Olson
5,735,502 A 4/1998 Levett et al.
5,806,314 A 9/1998 Younes
5,975,484 A 11/1999 Brugman et al.
6,158,505 A * 12/2000 Araujo ..... 251/1.3
6,164,619 A * 12/2000 Van Winkle et al. ..... 251/1.3
6,244,560 B1 6/2001 Johnson
6,260,817 B1 7/2001 Lam et al.

OTHER PUBLICATIONS

"BOP Replacement Parts Catalog" of the Cameron Division of Cooper Cameron Corporation, 52 pages plus front and back covers, printed in the USA Dec., 2000.

* cited by examiner

*Primary Examiner*—John Bastianelli
(74) *Attorney, Agent, or Firm*—E. Richard Zamecki

(57) ABSTRACT

A bidirectional sealing blowout preventer including bidirectional sealing blowout preventer rams, and fluid communication systems for equalizing pressure between the backs of ram guideways in a bidirectional sealing blowout preventer and a passageway through the blowout preventer. Methods for operating a bidirectional sealing blowout preventer to seal a well around a well pipe against downhole pressure to control the well, and to seal a well around a well pipe to pressure test another blowout preventer or other apparatus in a stack.

18 Claims, 7 Drawing Sheets

BIDIRECTIONAL SEALING BLOWOUT PREVENTER

TECHNICAL FIELD

The invention relates to ram-type blowout preventers used in well operations, such as in the recovery of hydrocarbons, for well control including preventing a well blowout. More particularly, the present invention pertains to the construction and operation of sealing devices included in the blowout preventers, and finds particular application in the operation and testing of subsea blowout preventers and other apparatus in a blowout preventer stack.

BACKGROUND OF THE INVENTION

Blowout preventers are typically included in the assembly at a wellhead when drilling or completing a well to close off the well to prevent a blowout. Such a blowout might occur, for example, when the well suddenly intersects a pocket of fluid under high pressure, which then blows up the well bore. A blowout preventer seals the well against the fluid pressure from below. A blowout preventer can also be used to seal off the well around a well pipe in normal drilling operations involving positive downhole pressure. In practice, multiple blowout preventers are arrayed in a vertical stack, which is positioned over the well, with the well piping extending up through the center of the blowout preventer stack.

FIGS. 1 and 2 provide two views of an underwater blowout preventer stack shown generally at 10. Various hydraulic lines, framework and control apparatus for operating the blowout preventer stack 10 are not shown for purposes of clarity. The stack 10 includes four ram-type blowout preventers 12, 14, 16 and 18. An annular blowout preventer 20, a connector 22, a second annular blowout preventer 24 and a flex joint 26 are arrayed above the ram-type blowout preventers 12–18. A riser adapter 28 is positioned at the top of the stack 10 for connection to a marine riser above (not shown). A wellhead connector 30 is located at the bottom of the stack 10 for connection to a wellhead below (not shown). In general, the number and kind of blowout preventers in a stack, as well as the order in which they are arrayed in the stack, may vary.

A ram-type blowout preventer includes a pair of linear drive devices, or linear actuators, located on opposite sides of a central housing to provide movement along a straight line, perpendicular to the vertical, toward and away from the housing. For example, a ram-type blowout preventer such as shown at 12 provides a pair of piston and cylinder assemblies 32 and 34 with the cylinders fixed on opposite sides of a central housing 36 positioned over the well so that the pistons are movable along a line perpendicular to the vertical, that is, perpendicular to the well bore at the surface of the well. As shown, the bottom two blowout preventers 12 and 14 have a common, extended central housing 36. A central vertical bore through the housing 36 is aligned with the well bore so that well pipe extending from the well passes upwardly through the housing along its central bore. The pistons are hydraulically operated to simultaneously move toward each other, or away from each other. Each piston carries a ram at the piston end toward the well, so that the two rams meet in a closed configuration at the housing central bore when the pistons are driven together, and are pulled apart by the pistons to an open configuration. The central vertical bores through housings of the ram-type blowout preventers 12–18 form part of a central vertical passageway extending from the wellhead and the well bore below, up through all of the elements in the blowout preventer stack 10 and on through the marine riser.

A cavity is provided within the central housing for each ram-type blowout preventer 12–18, that is, for each pair of piston and cylinder combinations 32/34. Each cavity intersects the vertical bore of the housing 36 and extends radially outwardly toward the piston and cylinder structures 32 and 34 in two guideways 38 and 40, with each guideway interposed between the central housing and a corresponding piston and cylinder assembly. The ram carried by a piston resides and moves within the corresponding guideway.

The rams in a multiple blowout preventer stack may operate in different ways in closing off the well. Pipe rams seal around a tubular pipe extending from the well, closing off the annulus between the well pipe and the well bore surface. Blind rams seal across the well with no pipe at the location of the blind ram. Shear, or cutting, rams shear the well pipe, but do not seal off the annulus around the pipe. Blind shear rams shear the well pipe and close and seal the well. A blowout preventer with blind shear rams is typically at the top of a ram-type blowout preventer stack, with various pipe rams in blowout preventers located below. In a typical application, the top ram-type blowout preventer 18 would be fitted with blind shear rams, and the lower preventers 12–16 would contain pipe rams.

FIG. 3 shows a matched pair of pipe rams generally at 42 and 44, and is used herein to illustrate various features of rams. To the extent that the rams 42 and 44 are alike, the same number label is used to identify their like parts and features. Each of the rams 42 and 44 includes a ram body 46 having a groove 48 in its front, or leading, end. A packer 50 is carried in the groove 48. A groove 52 extends across the top surface of the ram body 46. A top seal 54 is received within the top groove 52 such that the ends of the top seal extend to the ends of the packer 50. A T-slot 56 is cut into the back of each ram body 46 to receive a button at the end of a linear drive device (not shown), such as are included in the piston and cylinder assemblies 32 and 34 (FIGS. 1 and 2), used to operate the rams 42 and 44.

The ram bodies 46 are generally curved, oblong cylinders as shown. The guideways (not shown) are also curved, oblong cylindrical inner surfaces that receive the rams 42 and 44, and along which the rams are driven by the corresponding pistons. In general, blowout preventer ram bodies and corresponding guideways may also have other cross-sectional shapes, such as circular or rectangular. When the rams 42 and 44 are driven together, they meet at the well pipe (not shown) within the central vertical passageway within the blowout preventer stack 10. The pipe ram packers 50 feature a vertical, cylindrical groove 58 that receives the well pipe, and the front ends of the ram bodies 46 are cut to fit together with each other. Thus, in the closed configuration, the pipe rams 42 and 46 fit together and around the well pipe to enclose the well pipe in annular sealing engagement. To complete the sealing of the well with the rams 42 and 44 in the closed configuration, the rams must be sealed to their respective guideways against well fluid under pressure from moving around the rams and up into the housing above the level of the ram packers. This sealing is provided by the top seals 54 that engage the interior guideway surfaces in a sliding seal. Consequently, the combination of the top seal 54 and the packer 50 of a ram 42 or 44 completes the seal between the well pipe and the corresponding guideway, and the pair of rams 42 and 44 in the closed configuration completes the sealing of the annulus of the well bore surrounding the well pipe.

Each ram 42 and 44 is provided with a pressure equalization path in the form of a groove, or mud slot, 60 machined longitudinally into the bottom surface of the ram to communicate fluid pressure between the vertical bore of the central housing below the ram packer 50 and the respective guideway behind the ram seals. Thus, each ram 42 and 44 may be driven back and forth along its guideway without having to work against fluid pressure differentials between the area behind the ram and the central vertical passageway through the stack 10 below the packers 50.

Each of the ram-type blowout preventers 12–18 has an access port 62 (FIGS. 1 and 2) toward the bottom of each side of the corresponding central housing 36. The ports 62 of each blowout preventer 12–18 are positioned to communicate with the central vertical passageway within the stack 10 at a location below where the ram packers of these blowout preventers would cooperate to form a seal. A choke line 64 extends along the side of the stack 10 and is connected to access ports 62 of the blowout preventers 12 and 16, and controlled there by valves 66. A choke line can be used to bleed off high fluid pressure from downhole by tapping through an access port 62 at a closed and sealed blowout preventer. A kill line 68 extends along the opposite side of the stack 10 and is connected to access ports 62 of the remaining ram-type blowout preventers 14 and 18, and controlled there by valves 70. A kill line can be used to feed high-pressure fluid or high-density mud into the well through an access port 62 at a closed and sealed blowout preventer.

In practice, blowout preventers are periodically tested for their ability to seal against downhole pressures. This is particularly true in cases of underwater installations. A test tool is lowered through the blowout preventer stack on a pipe, and anchored below the lowest blowout preventer in the stack. The test tool is actuated to seal the well at that point. A blowout preventer to be tested is moved to its close, or sealed configuration. Then, fluid pressure is communicated into the annular region surrounding the pipe above the test tool and below the blowout preventer under investigation by means of the choke line 64 or the kill line 68 to carry out the testing. A major disadvantage of this testing operation is that it requires that the drill string, or whatever tubing is being used in the well, must be pulled from the well so that the test tool may be installed in the well. After testing, the test tool is removed and the original tubing is then run back into the well. Such tripping is time consuming and expensive, particularly in the case of a deep well or of a well in deep water.

An alternative to pulling the well pipe to test the rams is provided by adding another ram-type blowout preventer at the bottom of the blowout preventer stack. The rams of the added blowout preventer are installed inverted, so that their sliding seals that contact the guideways are on the bottom of the rams rather than on the top of the rams, as illustrated in FIG. 3. Also, the pressure equalization grooves 60 are on the top of the inverted rams to allow fluid communication between the areas behind the two rams and the central passageway above the inverted rams and below the blowout preventer being tested. These inverted rams are closed to seal about the well pipe already in place in the well, against fluid pressure from above the rams. Then, fluid pressure is communicated into the annular region surrounding the well pipe above the inverted rams and below the blowout preventer under investigation by means of the choke line 64 or the kill line 68 to carry out the testing. The disadvantage of this test technique is that it requires an extra ram-type blowout preventer that is used only for testing other blowout preventers in the stack.

It is advantageous and desirable to provide a technique for testing blowout preventers and other apparatus in a stack that does not require pulling the well pipe, and a technique that does not add major apparatus to the blowout preventer stack that is only used for testing purposes. The present invention provides for such a technique.

SUMMARY OF THE INVENTION

The present invention provides a bidirectional sealing ram-type blowout preventer, and provides a blowout preventer stack including a bidirectional sealing ram-type blowout preventer.

A bidirectional sealing ram-type blowout preventer has bidirectional sealing rams having top seals, bottom seals, and packers at the front of each ram, a selectively operable first fluid communication system for equalizing fluid pressure between the back of each ram with fluid pressure below the ram packers, and a selectively operable second fluid communication system for equalizing fluid pressure between the back of each ram with fluid pressure above the ram packers.

A blowout preventer ram body according to the present invention has a receptacle at the front end for receiving a packer, a first groove across the top for receiving a top seal member and a second groove across the bottom for receiving a bottom seal member. A blowout preventer ram according to the present invention has a body, a receptacle at the front end of the body, a packer carried in the receptacle, a first groove across the top of the body, a top seal member carried in the first groove, a second groove across the bottom of the body, and a bottom seal member carried in the second groove.

According to the present invention, a ram-type blowout preventer fluid communication system has a selectively operable first fluid communication system for equalizing fluid pressure between the back of each ram of the blowout preventer with fluid pressure below the ram packers, and a selectively operable second fluid communication system for equalizing fluid pressure between the back of each ram of the blowout preventer with fluid pressure above the ram packers. A fluid communication system according to the present invention further includes first control apparatus for selectively opening and closing the first fluid communication system, and second control apparatus for selectively opening and closing the second fluid communication system. A control unit connected to the first control apparatus and to the second control apparatus may selectively operate the first and second control apparatus to open and close the first and second fluid communication systems, respectively. The first control apparatus may include at least one valve and the second control apparatus may include at least one valve.

The present invention provides a ram-type blowout preventer including a first ram connected to a first linear actuator and movable within a first guideway and including a ram body having a top, a bottom, a front end, a back end, a packer carried in a receptacle at the front end of the body, a top seal carried in a groove across the top of the body, a bottom seal carried in a groove across the bottom of the body, and being connected to the first linear actuator at the back end of the body, a second ram connected to a second linear actuator and movable within a second guideway and including a ram body having a top, a bottom, a front end, a back end, a packer carried in a receptacle at the front end of the body, a top seal carried in a groove across the top of the body, a bottom seal carried in a groove across the bottom of the body, and being connected to the second linear actuator at the back end of the body, a first fluid communication system between a central vertical passageway, through a central housing of the blowout preventer, below the level of the ram packers and locations in the first and second guideways behind the rams, first control apparatus for selectively opening and closing the first fluid communication system, a second fluid communication system between the central vertical passageway above the level of the ram packers and locations in the first and second guideways behind the rams, and second control apparatus for selectively opening and closing the second fluid communication system. The first linear actuator may comprise a piston and cylinder assembly and the second linear actuator may comprise a piston and cylinder assembly. The first fluid communication system may comprise fluid communication lines and at least one valve, and the second fluid communication system may comprise fluid communication lines and at least one valve. The first control apparatus may comprise at least one valve, and the second control apparatus may comprise at least one valve. The first and second control apparatus may be connected to a control unit by which the first and second control apparatus may be selectively operated to open and close the first and second fluid communication systems, respectively. The first fluid communication system may include fluid communication lines and may communicate with the central vertical passageway through at least one access port, the first control apparatus may include at least one valve, the second fluid communication system may include fluid communication lines and may communicate with the central vertical passageway through at least one access port, and the second control apparatus may include at least one valve. The second fluid communication system may communicate with the central vertical passageway through at least one access port that is located in the central housing of the blowout preventer, in an extension of the central housing above the blowout preventer, or in the central housing of a second, higher blowout preventer. All of the access ports by which the first and second fluid communication systems communicate with the central vertical passageway may be located in the central housing of the blowout preventer.

A method of operating a bidirectional sealing ram-type blowout preventer according to the present invention includes providing fluid communication between the area of fluid pressure against which the rams of the bidirectional sealing ram-type blowout preventer are to seal and the backs of the rams, and manipulating the rams between an open configuration and a closed, sealing configuration.

The present invention provides a method of operating a bidirectional sealing ram-type blowout preventer, including bidirectional sealing rams having top seals, bottom seals and front packers, operable by corresponding linear actuators for movement in corresponding guideways within a central housing to selectively seal the annulus around a pipe located within a central vertical passageway through the central housing, a selectively operable first fluid communication system between the central vertical passageway below the level of the ram packers and locations in the first and second guideways behind the rams, and a selectively operable second fluid communication system between the central vertical passageway above the level of the ram packers and locations in the first and second guideways behind the rams, including opening one and closing the other of the first and second fluid communication systems and operating the linear actuators to selectively move the rams in the corresponding guideways. The first and second fluid communication systems may be selectively operated to open and close using first control apparatus and second control apparatus, respectively, and the first and second control apparatus may be connected to a control unit by which the first and second control apparatus may be selectively operated. The first and second control apparatus may each include at least one valve. A method of operating the bidirectional sealing ram-type blowout preventer to apply fluid pressure above the bidirectional sealing ram-type blowout preventer includes closing the first fluid communication system with the second fluid communication system open, operating the linear actuators to move the rams to seal around a pipe in the central vertical passageway through the central housing, and applying fluid pressure within the vertical passageway above the packers of the rams of the bidirectional sealing ram-type blowout preventer. The present invention thus provides a method of testing a blowout preventer that is positioned above the bidirectional sealing ram-type blowout preventer. A method of operating the bidirectional sealing ram-type blowout preventer to seal against fluid pressure from below includes closing the second fluid communication system with the first fluid communication system open and operating the linear actuators to move the rams to seal around a pipe in the central vertical passageway through the central housing.

A method of pressure testing a blowout preventer in a blowout preventer stack, according to the present invention, includes providing a bidirectional sealing ram-type blowout preventer in the blowout preventer stack at a position below the blowout preventer to be tested, providing fluid communication between the area above the rams of the bidirectional sealing ram-type blowout preventer and below the blowout preventer to be tested, and the backs of the rams of the bidirectional sealing ram-type blowout preventer, closing the rams of the bidirectional sealing ram-type blowout preventer to sealing configuration, and, with the blowout preventer to be tested in its sealing configuration, applying fluid pressure between the rams of the bidirectional sealing ram-type blowout preventer and the blowout preventer to be tested.

The present invention provides a bidirectional sealing ram-type blowout preventer for sealing a well around a well pipe against fluid pressure from below for well control as well as sealing around a well pipe against fluid pressure from above for testing or pressure-activating other apparatus.

DETAILED DESCRIPTION OF PRESENTLY PREFERRED EMBODIMENTS

The present invention is illustrated and described herein in multiple preferred embodiments.

Figure 4:
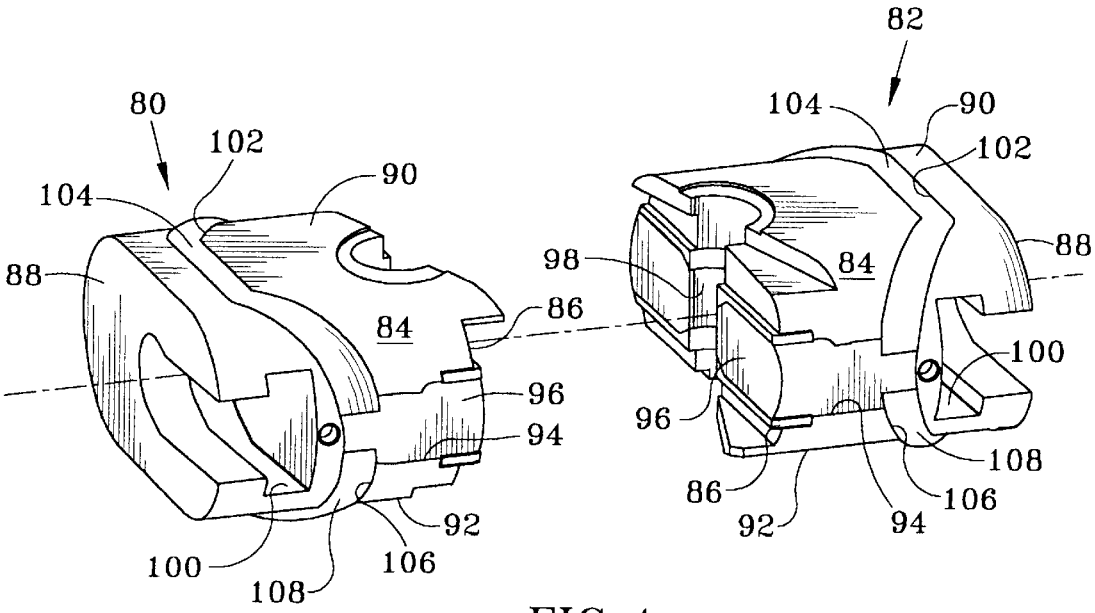
FIG. 4 is a view similar to FIG. 3, but showing a pair of pipe rams according to the present invention.

FIG. 4 shows a matched pair of bidirectional sealing pipe rams according to the present invention, shown generally at 80 and 82. To the extent the rams 80 and 82 are alike, some like features of the two rams are identified by the same number labels. With the exceptions discussed below, the rams 80 and 82 operate within guideways of a ram-type blowout preventer as described above.

Each of the rams 80 and 82 has a ram body 84 with a discernible front, or leading, end, 86, back end 88, top 90 and bottom 92. The ram body front end 86 is broken by a groove, or receptacle, 94 in which is mounted a packer 96. The front of the packer 96 is broken by a vertical, cylindrical groove 98. Also, the ram body front end 86 is structured with recesses and protrusions, with the front ends of the two rams 82 and 84 complimentary so that the two rams mesh together as their packers 96 seal around a well pipe received in the packer grooves 98. Each ram body back end 88 has a T-slot 100 to receive a button on the end of a piston or the like (not shown) whereby the ram 80/82 is driven forward or retracted by the corresponding linear drive mechanism, or actuator, such as a piston and cylinder assembly (not shown).

Each ram body top 90 is broken by a groove 102 that extends across the top and connects to the packer groove 94. A top seal 104 is mounted in the top groove 102 to provide a sliding seal with the surface of the guideway (not shown) wherein the ram resides. Thus, the top seals 104 cooperate with the packers 96 to seal the central vertical passageway through the corresponding blowout preventer stack against fluid pressure from below the rams in their closed, sealing configuration around a well pipe.

Each ram body bottom 92 is broken by a groove 106 that extends across the bottom and connects to the packer groove 94. A bottom seal 108 is mounted in the bottom groove 106 to also provide a sliding seal with the surface of the guideway (not shown) wherein the ram resides. Thus, the bottom seals 108 cooperate with the packers 96 to seal the central vertical passageway through the corresponding blowout preventer stack against fluid pressure from above the rams in their closed, sealing configuration around a well pipe. Therefore, the rams 80 and 82 seal the central vertical passageway through the blowout preventer stack against fluid pressure from above and below the rams.

In view of the fact that the rams 80 and 82 seal against the guideway surface both along the ram body tops 90 and the ram body bottoms 92, in fact all around the ram bodies 84, there can be no pressure equalization groove breaking the surface of the ram body from the front 86 of the ram to the back 88. Pressure equalization is provided by another mechanism described below.

Figure 5:
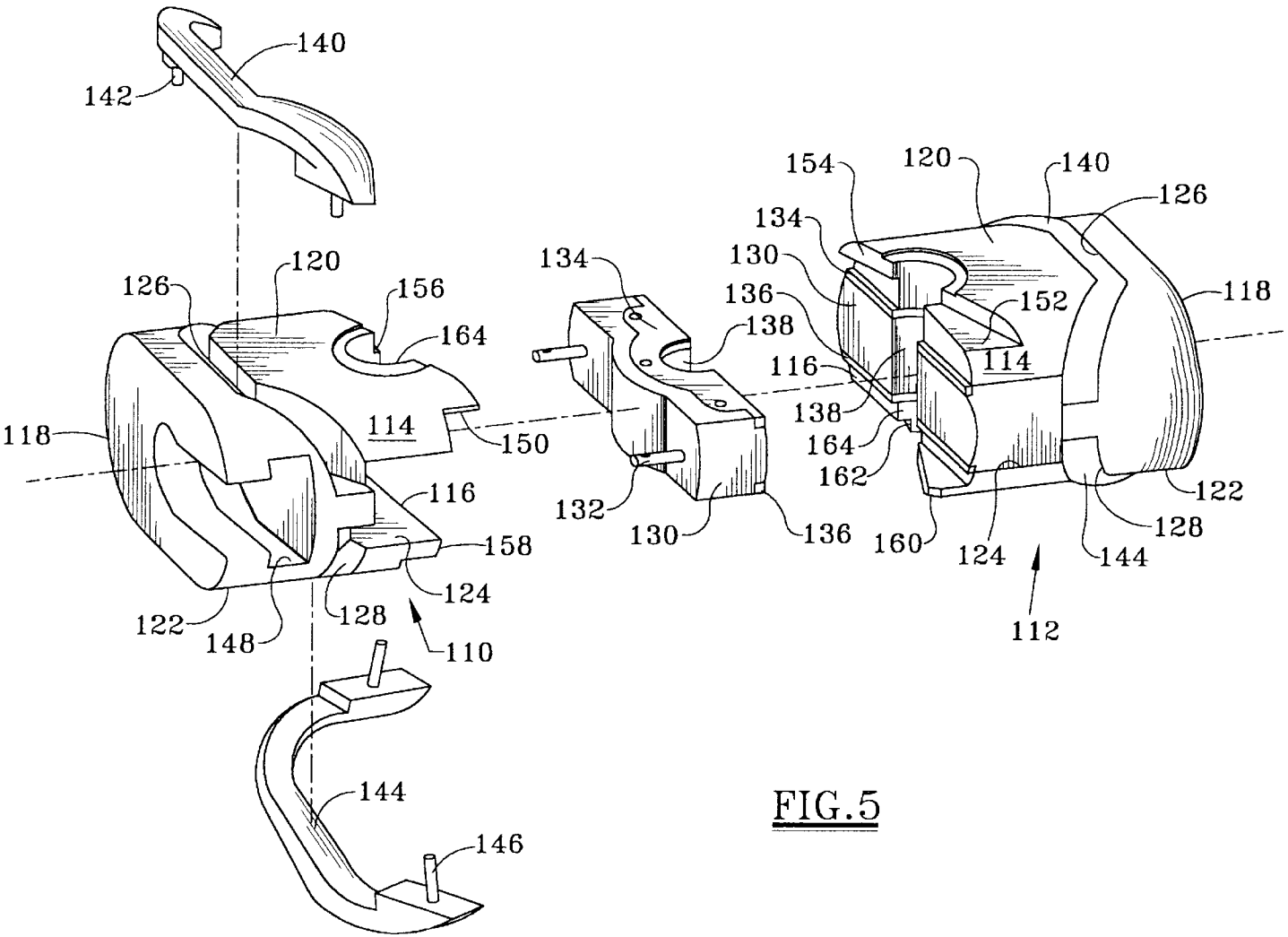
FIG. 5 is an isometric view of another pair of pipe rams according to the present invention, showing one of the rams in exploded view.

FIG. 5 shows another matched pair of bidirectional sealing pipe rams according to the present invention, shown generally at 110 and 112, and is presented to show one of the rams 110 in exploded view. To the extent the rams 110 and 112 are alike, some like features of the two rams are identified by the same number labels. Again, with the exceptions discussed below, the rams 110 and 112 operate within guideways of a ram-type blowout preventer as described above.

The rams 110 and 112 are similar to the rams 80 and 82 of FIG. 4. Each ram 110 and 112 has a ram body 114 with a front end 116, a back end 118, a top 120 and a bottom 122. The front end 116 is broken by a front groove, or receptacle, 124, the top 120 is broken by a top groove 126, and the bottom 122 is broken by a bottom groove 128. It can be seen in the exploded view of the ram 110 that the top groove 126 extends across the ram body top 120 and joins with the front groove 124. Also, the bottom groove 128 extends across the ram body bottom 122 and connects to the front groove 124.

A packer 130 fits within the front receptacle 124, and is secured there by pins 132 received in holes (not shown) within the front groove. The top and bottom of the packer 130 are partially lined by metal plates 134 and 136, respectively, that enhance the fit of the packer within the front groove 124 of the metal ram body 114. The front of the packer 130 is broken by a vertical cylindrical groove 138 that receives a well pipe in the closed ram configuration, as discussed above. The front edges of the plates 134 and 136 are cut to follow the grooved profile of the front of the packer 130.

A top seal 140 is shaped to fit within the top groove 126, and to protrude slightly out of the groove to maintain sliding sealing engagement with the guideway surface (not shown). The top seal 140 is secured in the top groove 126 by pins 142 received in holes (not shown) within the top groove.

A bottom seal 144 is shaped to fit within the bottom groove 128, and to protrude slightly out of the groove to maintain sliding sealing engagement with the guideway surface (not shown). The bottom seal 144 is secured in the bottom groove 128 by pins 146 received in holes (not shown) within the bottom groove.

As shown, particularly in the view of the ram 112, the top seal 140 and the bottom seal 144 extend around the ram body 114 to contact the packer 130 so that a complete and continuous seal circumscribes the ram body and extends across the front of the ram body.

The back end 118 of the ram body 114 is broken by a T-slot 148 to receive a button on the end of a piston or the like (not shown) whereby the ram 110/112 is driven forward or retracted by a corresponding linear actuator, or drive mechanism, such as a piston and cylinder assembly (not shown). The front end 116 of each ram 110 and 112 features protrusions and cutbacks that compliment protrusions and cutbacks on the front end of the other ram when the two rams are moved together in the closed configuration. Thus, an upper protrusion 150 of the ram 110 is received by an oppositely facing upper cutback 152 of the ram 112, and an upper protrusion 154 of the ram 112 is received by an oppositely facing upper cutback 156 of the ram 110. Similarly, a lower cutback 158 of the ram 110 receives an oppositely facing lower protrusion 160 of the ram 112, and a lower cutback 162 of the ram 112 receives an oppositely facing lower protrusion (not visible) of the ram 110. Further, the front end of the ram body 114 features cylindrical cuts 164 to accommodate well pipe to be received by the packer 130.

Figure 6:
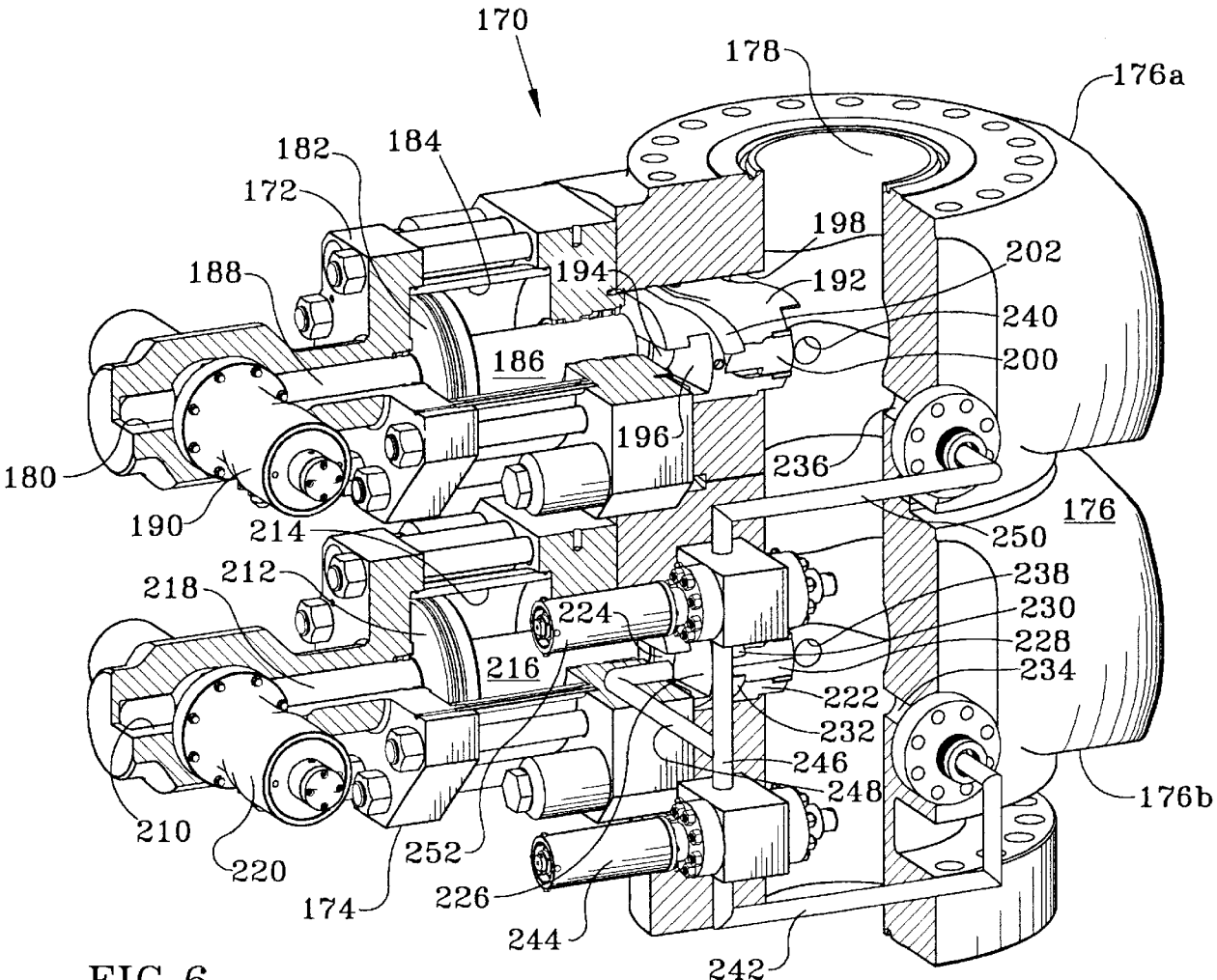
FIG. 6 is an isometric view, in quarter section, of a portion of a pair of blowout preventers including a bidirectional sealing ram-type blowout preventer according to the present invention.

The use of bidirectional sealing rams such as 80/82 and 110/112 within a blowout preventer may be further appreciated by reference to FIG. 6 wherein a portion of a pair of two ram-type blowout preventers is shown generally at 170. An upper blowout preventer 172 and a lower blowout preventer 174 are joined by way of an extended central housing 176 assembly, having an upper housing portion 176*a* and a lower housing portion 176*b*. The extended housing 176 provides a central vertical passageway 178 that is part of the central vertical passageway of the blowout preventer stack in which the tandem preventers 170 might be included.

Each of the blowout preventers 172 and 174 has a pair of linear actuators in the form of piston and cylinder assemblies on opposite sides of the central housing 176, although any appropriate mechanisms to produce linear motion may be used. Only the piston and cylinder assemblies and related features on one side of the housing 176 are illustrated in FIG. 6, the piston and cylinder assemblies and related features on the opposite side of the housing being similar in construction and operation to those illustrated. In particular, the upper blowout preventer 172 includes a piston and cylinder assembly 180 with a piston head 182 positioned for movement within a cylindrical chamber 184. A piston rod 186 is joined to the piston head 184 toward the central housing side of the piston head, and a second rod 188 is joined to the piston head on the opposite side. Hydraulic fluid is circulated through hydraulic fluid lines and access ports (not shown) into and out of the chamber 184 on both sides of the piston head 182 to selectively move the piston head toward or away from the central housing 176*a*. The rods 186 and 188 move with the piston head 182. A locking mechanism 190 may be actuated to engage the rod 188 to lock the piston head 182 in its closed position toward the central housing 176*a* in the event that hydraulic pressure within the chamber 184 holding the piston head in the closed position is lost, or is removed. Both blowout preventers 172 and 174 are illustrated in their retracted, open configuration.

Figure 1:
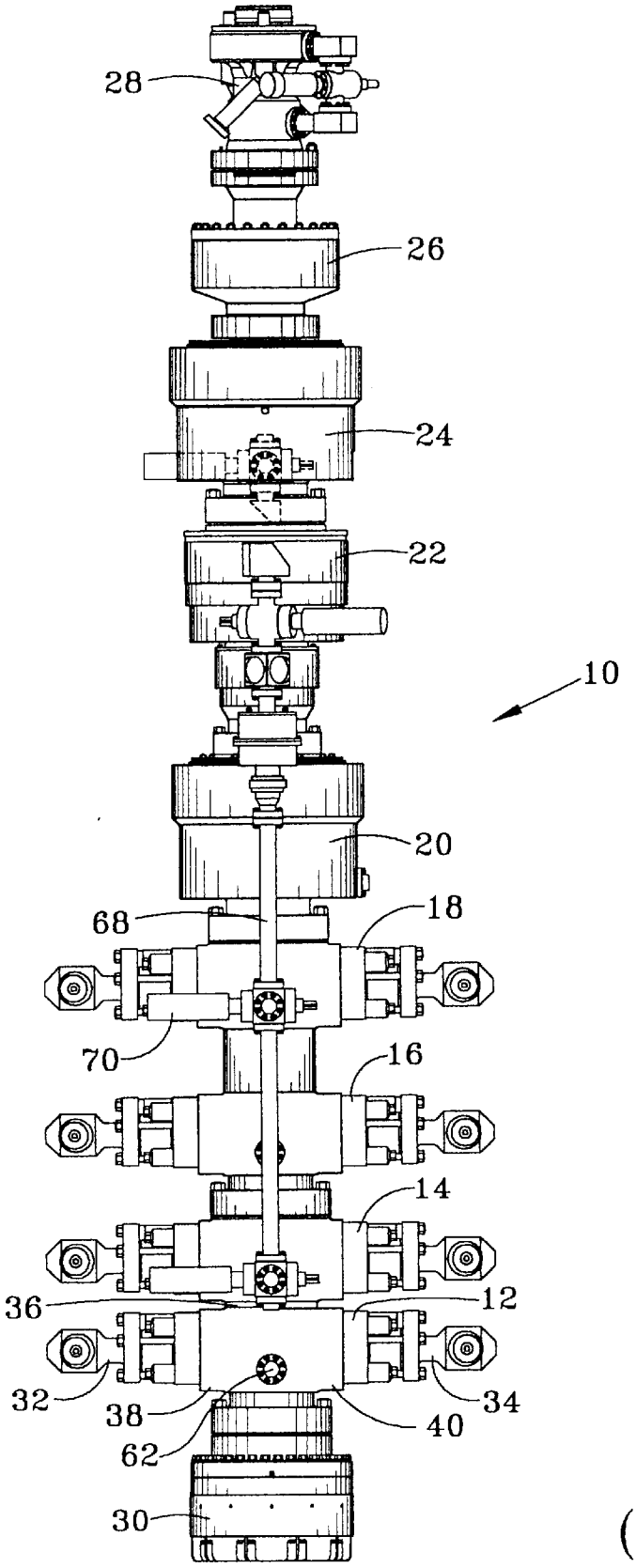
FIG.1 (PRIOR ART)
FIG. 1 is a side elevation of an underwater blowout preventer stack as known in the prior art.
Figure 2:
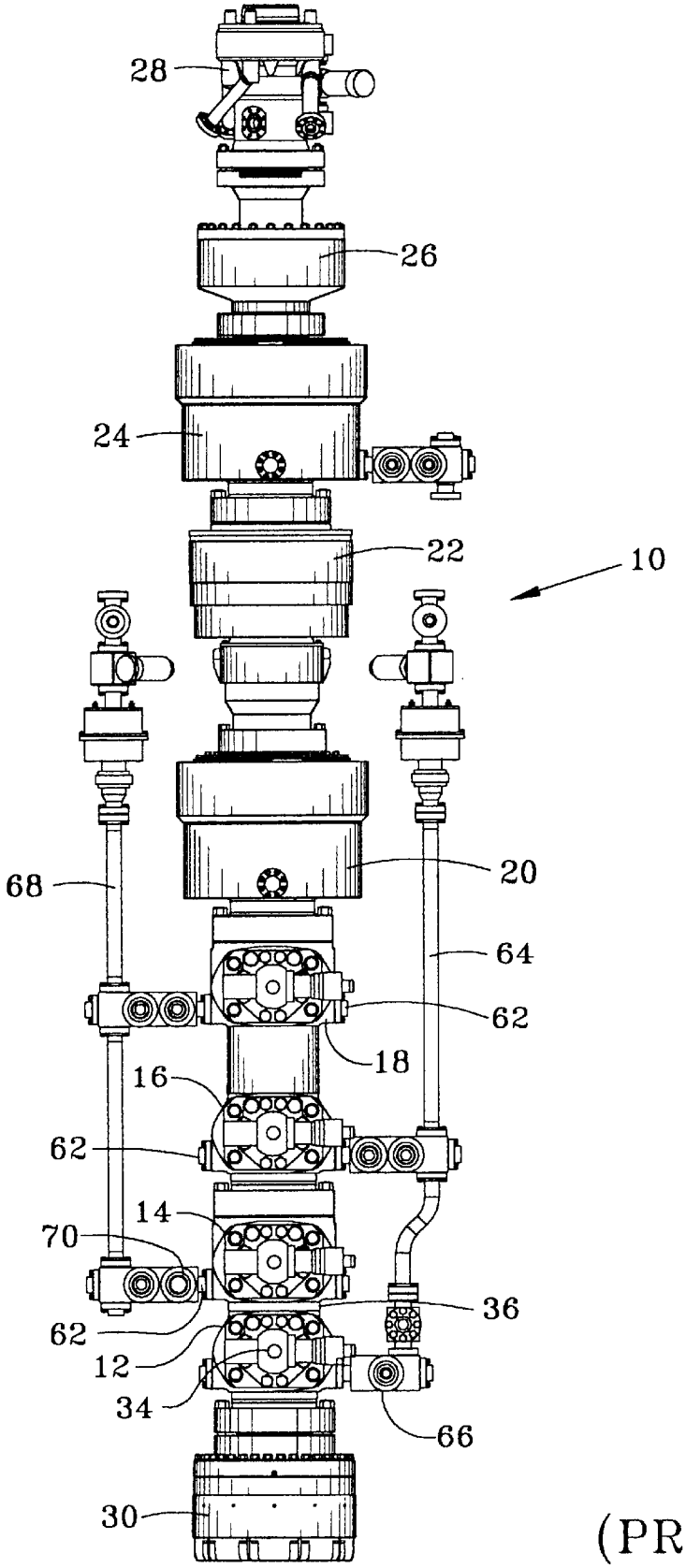
FIG.2 (PRIOR ART)
FIG. 2 is another side elevation of the blowout preventer stack of FIG. 2.
Figure 3:
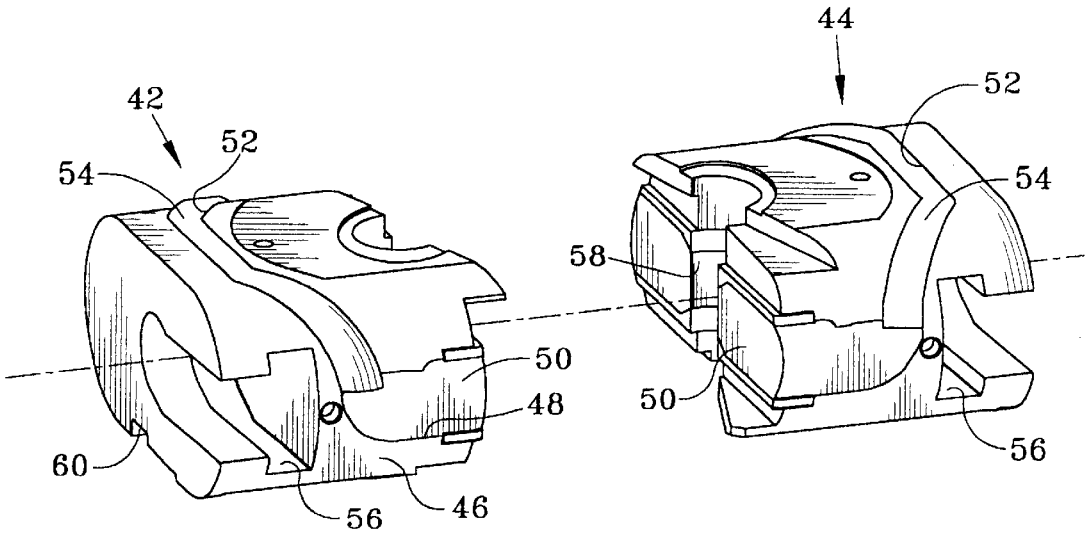
FIG.3 (PRIOR ART)
FIG. 3 is an isometric view of a pair of pipe rams as known in the prior art.

A standard pipe ram 192, such as like the rams 42 and 44 of FIG. 3, is attached to the piston 186 by a button 194 on the end of the piston 186 residing in a T-slot 196 on the back of the ram. The standard ram 192 is movable within a guideway 198. The ram 192 carries a packer 200 at its front end, and a top seal 202 across its top. Thus, the ram 192 is operable to move longitudinally along the guideway 198 by operation of the piston and cylinder assembly 180, while maintaining a sliding seal with the top surface of the guideway 198 by means of the ram top seal 202 as joined to the packer 200. A fluid pressure equalization slot (not shown) is provided along the bottom of the ram 192 to allow fluid communication between the guideway 198 behind the ram and the central vertical passageway 178 below the level of the packer 200 when the ram is in the closed configuration, as discussed above. The ram 192 is illustrated in the open configuration.

The lower blowout preventer 174 includes a piston and cylinder assembly 210 with a piston head 212 positioned for movement within a cylindrical chamber 214. A piston rod 216 is joined to the piston head 212 toward the central housing side of the piston head, and a second rod 218 is joined to the piston head on the opposite side. Hydraulic fluid is circulated through hydraulic fluid lines and access ports (not shown) into and out of the chamber 214 on both sides of the piston head 212 to selectively move the piston head toward or away from the central housing 176*b*. The rods 216 and 218 move with the piston head 212. A locking mechanism 220 may be actuated to engage the rod 218 to lock the piston head 212 in its closed position toward the central housing 176*b* in the event that hydraulic pressure within the chamber 214 holding the piston head in the closed position is lost, or is removed.

A bidirectional sealing pipe ram 222 according to the present invention, such as like the rams 80 and 82 of FIG. 4, or the rams 110 and 112 of FIG. 5, for example, is attached to the piston 216 by a button 224 on the end of the piston 216 residing in a T-slot 226 on the back of the ram. The bidirectional sealing ram 222 is movable within a guideway (not visible). The ram 222 carries a packer 228 at its front end, a top seal 230 across its top and a bottom seal 232 across its bottom. Thus, the ram 222 is operable to move longitudinally along its corresponding guideway by operation of the piston and cylinder assembly 210, while maintaining a sliding seal all around the surface of the guideway by means of the ram top seal 230 and the ram bottom seal 232 joined to the packer 228. The ram 192 is illustrated in the open configuration. As discussed above, the bidirectional sealing ram of the present invention has a top seal and a bottom seal so that there is no longitudinal pressure equalization groove cut along the surface of the ram. A fluid communication system is provided to equalize the fluid pressure between the back and the front of the ram 222 above or below its packer 228 as need to move the ram in its guideway.

The lower housing portion 176*b* has a side access port 234 on the front of the housing portion as illustrated, below the level of the packer 228 of the bidirectional sealing ram 222. The upper housing portion 176*a* has a side access port 236 on the front of the housing portion as illustrated, below the level of the packer 200 of the standard ram 192, and also above the level of the packer 228 of the bidirectional sealing ram 222. Similarly, the lower housing portion 176*b* has a side access port 238 on the back of the housing portion as illustrated, below the level of the packer 228 of the bidirectional sealing ram 222. The upper housing portion 176*a* has a side access port 240 on the back of the housing portion as illustrated, below the level of the packer 200 of the standard ram 192, and also above the level of the packer 228 of the bidirectional sealing ram 222.

A fluid communication system according to the present invention is shown, in part, connected to the front access ports 234 and 236. A first fluid communication system comprises a fluid communication line 242 connected between the lower access port 234 and a valve 244. A second fluid communication line 246 leaves the valve 244 and is joined to a third fluid communication line 248. A second fluid communication system comprises a fluid communication line 250 connected between the upper access port 236 and a valve 252. The second fluid communication line 246 also connects to the valve 252, and thus connects this valve 252 to the third fluid communication line 248. The fluid communication line 248 connects to the interior of the guideway (not visible) in which the bidirectional sealing ram 222 resides and moves, with the connection at a point behind the back end of the ram.

Figure 7:
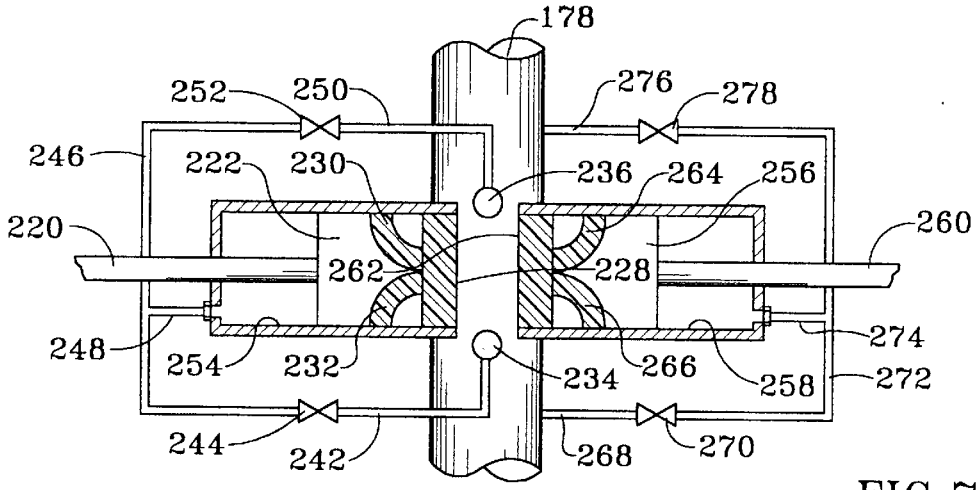
FIG. 7 is a schematic side elevation of a portion of a bidirectional sealing blowout preventer according to the present invention, illustrating the fluid communication systems of FIG. 6.

The first and second fluid communication systems illustrated in FIG. 6 and described above in part are shown schematically in the diagram of FIG. 7, wherein the ram 222 is shown in its guideway 254. FIG. 7 is schematic only, and not drawn to scale. Further, the right side of the blowout preventer 174 of FIG. 6 is partially represented in FIG. 7 which shows its bidirectional sealing ram 256 in its guideway 258 opposite the guideway 254. The ram 256 is connected to a corresponding piston and cylinder assembly (not shown) by a piston 260 for selected movement within the guideway 258, and carries a front packer 262, a top seal 264 and a bottom seal 266. The two rams 222 and 256 are mutually complimentary in the sense that, when they come together in the closed configuration at a well pipe within the central vertical passageway, the packers 228 and 262 form a sealing ring around the well pipe, and the front ends of the two rams fit together, as discussed above. The first and second fluid communication systems described above in connection with the ram 222 continue in like constructions related to the ram 256. Specifically, a first fluid communication line 268 is connected between the central vertical passageway by way of the lower housing access port 238 (FIG. 6) and a valve 270. A second fluid communication line 272 extends beyond the valve 270 and joins a third fluid communication line 274, which connects to the interior of the guideway 258 in which the bidirectional sealing ram 256 resides and moves, with the connection at a point behind the back end of the ram. Also, a fluid communication line 276 is connected between the upper housing access port 240 (FIG. 6) and a valve 278. The second fluid communication line 272 also connects to the valve 278, and thus connects the valve 278 to the third fluid communication line 248 and thus to the back of the guideway 258.

It will be noted that both guideways 254 and 258 are connected to the central vertical passageway 178 below the packers 228 and 262 by way of the fluid communications lines 242, 246 and 248 and the valve 244 in the case of ram 222, and the fluid communication lines 268, 272 and 274 and the valve 270 in the case of ram 256, and these fluid communication lines and valves are included in the first fluid communication system. Also, it will be noted that both guideways 254 and 258 are connected to the central vertical passageway 178 above the packers 228 and 262 by way of the fluid communications lines 246, 248 and 250 and the valve 252 in the case of ram 222, and the fluid communication lines 272, 274 and 276 and the valve 278 in the case of ram 256, and these fluid communication lines and valves are included in the second fluid communication system. Both fluid communication systems share the fluid communication lines 248 and 274. In practice, the rams 222 and 256 are operated together within their respective guideways 254 and 258, and therefore the first fluid communication system will be operated for both rams together, and the second fluid communication system will be operated for both rams together. The first and second fluid communication systems are operated to allow or block fluid flow therethrough by opening or closing their respective valves. Thus, the valves 244 and 270 provide first control apparatus for operating the first fluid communication system, and the valves 252 and 278 provide second control apparatus for operating the second fluid communication system. The operation of the first and second fluid communication systems may be appreciated by reference to FIGS. 6 and 7.

The bidirectional sealing blowout preventer 174 may be utilized as a blowout preventer to seal a well around a well pipe against downhole fluid pressure as in the case of a standard pipe ram blowout preventer with the exception that the first fluid communication system is utilized to equalize fluid pressure between the guideways 254 and 258 behind the rams 222 and 256, respectively, and the central vertical passageway 178 below the ram packers 228 and 262. To carry out this operation, the second fluid communication system connected to the upper access ports 236 and 240 is closed by closing the valves 252 and 278. The first fluid communication system connected to the lower access ports 234 and 238 is open to fluid flow by the opening of the valves 244 and 270. Hence, as the piston and cylinder assembly 210 is operated to drive the ram 222 toward its closed configuration, fluid pressure from the central vertical passageway 178 below the level of the ram packers 228 and 262, and therefore from within the well bore, is communicated through the access port 234, the fluid communication line 242, the valve 244, the fluid communication line 246 and the fluid communication line 248 to the guideway 254 behind the ram 222. Similarly, as the ram 256 is driven toward its closed configuration, fluid pressure from the central vertical passageway 178 below the level of the ram packers 228 and 262, and therefore from within the well bore, is communicated through the access port 238, the fluid communication line 268, the valve 270, the fluid communication line 272 and the fluid communication line 274 to the guideway 258 behind the ram 256. With the rams closed and sealed about the well pipe, the annulus surrounding the well pipe within the passageway 178 is closed to avert or shut down a blowout of pressure up the passageway from the well bore. When the piston and cylinder assembly 210 is operated to retract the ram 222 to its open configuration, fluid pressure from behind the ram in the guideway 254 is communicated back through the fluid communication lines 248, 246, 242 and the valve 244 to the access port 234 and into the central vertical passageway 178. Likewise, when the ram 256 is retracted to its open configuration, fluid pressure from behind the ram in the guideway 258 is communicated back through the fluid communication lines 274, 272, 268 and the valve 270 to the access port 238 and into the central vertical passageway 178. Thus, the rams 222 and 256 can be moved within the guideways 254 and 258, respectively, without resistance from a pressure differential. Throughout this operation, and with the rams 222 and 258 in the closed configuration about a well pipe (not shown) within the central vertical passageway 178, the rams maintain sealing engagement with the guideways 254 and 258, respectively, against down hole fluid pressure within the annulus surrounding the well pipe in the passageway 178. This sealing engagement is accomplished using the ram top seals 230 and 264.

The bidirectional sealing blowout preventer 174 may be utilized to seal around a well pipe (not shown) within the central vertical passageway 178 to allow introduction of high fluid pressure within the passageway to pressure test a blowout preventer or other apparatus, or to pressure-activate other equipment, above the blowout preventer 174. To carry out this operation, the first fluid communication system connected to the lower access ports 234 and 238 is closed by closing the valves 244 and 270. The second fluid communication system connected to the upper access ports 236 and 240 is open to fluid flow by the opening of the valves 252 and 278. Hence, as the piston and cylinder assembly 210 is operated to drive the ram 222 toward its closed configuration, fluid pressure from the central vertical passageway 178 above the level of the ram packers 228 and 262 is communicated through the access port 236, the fluid communication line 250, the valve 252, the fluid communication line 246 and the fluid communication line 248 to the guideway 254 behind the ram 222. Similarly, as the ram 256 is driven toward its closed configuration, fluid pressure from the central vertical passageway 178 above the level of the ram packers 228 and 262 is communicated through the access port 240, the fluid communication line 276, the valve 278, the fluid communication line 272 and the fluid communication line 274 to the guideway 258 behind the ram 256. With the rams 222 and 256 in the closed and sealing configuration, the blowout preventer to be tested is closed, or other apparatus to be tested or activated is prepared, and fluid pressure within the annulus surrounding the well pipe within the passageway 178 is increased to conduct the pressure test, or pressure-activate the apparatus. When the test is completed, or the apparatus is pressure-activated, the high pressure is released, and the rams 222 and 256 may be retracted. The test or activation fluid pressure may be communicated to, and released from, the central vertical passageway utilizing a kill line or a choke line, as discussed above. When the piston and cylinder assembly 210 is operated to retract the ram 222 to its open configuration, fluid pressure from behind the ram in the guideway 254 is communicated back through the fluid communication lines 248, 246, 250 and the valve 252 to the access port 236 and into the central vertical passageway 178. Likewise, when the ram 256 is retracted to its open configuration, fluid pressure from behind the ram in the guideway 258 is communicated back through the fluid communication lines 274, 272, 276 and the valve 278 to the access port 240 and into the central vertical passageway 178. Thus, the rams 222 and 256 can be moved within the guideways 254 and 258, respectively, without resistance from a pressure differential. Throughout this operation, and with the rams 222 and 258 in the closed configuration about a well pipe (not shown) within the central vertical passageway 178, the rams maintain sealing engagement with the guideways 254 and 258, respectively, against high fluid pressure within the annulus surrounding the well pipe in the passageway 178 used to pressure test a blowout preventer or other apparatus, or to pressure-activate other equipment, above the blowout preventer 174. This sealing engagement is accomplished using the ram bottom seals 232 and 266.

Figure 8:
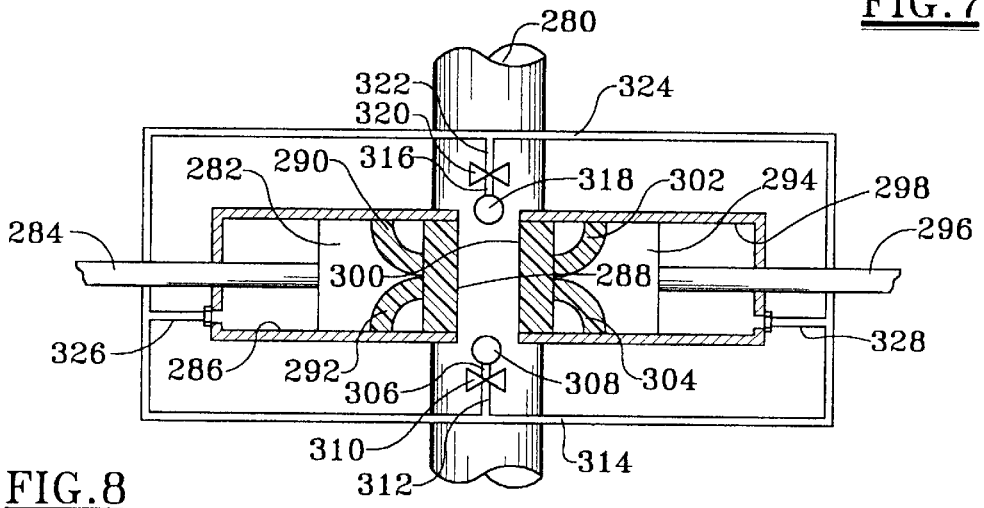
FIG. 8 is a view similar to FIG. 7, but showing another version of fluid communication systems.

Another version of a fluid communication system for operation of bidirectional sealing rams according to the present invention is shown schematically in FIG. 8. A bidirectional sealing ram-type blowout preventer according to the present invention is positioned with a central vertical passageway 280 extending through the blowout preventer. A bidirectional sealing ram 282 is connected to a linear actuator by a rod 284 for movement within a guideway 286. The ram 282 carries a front packer 288, a top seal 290 and a bottom seal 292. A bidirectional sealing ram 294 is connected to a linear actuator by a rod 296 for movement within a guideway 298. The ram 294 carries a front packer 300, a top seal 302 and a bottom seal 304. The rams 282 and 294 seal the annulus around a pipe (not shown) within the passageway 280 and fit together, in the closed configuration.

A fluid communication line 306 connects between the interior of the passageway 280 by way of an access port 308, and a valve 310. Another fluid communication line 312 connects the valve 310 to a fluid communication line 314. A fluid communication line 316 connects between the interior of the passageway 280 by way of an access port 318, and a valve 320. Another fluid communication line 322 connects the valve 320 to the fluid communication line 314. A fluid communication line 326 connects the fluid communication line 314 to the interior of the guideway 286 behind the ram 282, and a fluid communication line 328 connects the fluid communication line 314 to the interior of the guideway 298 behind the ram 294. The access port 308 opens to the passageway 280 below the level of the rams 282 and 294, and the access port 318 opens to the passageway 280 above the level of the rams. A first fluid communication system comprises the fluid communication lines 306, 312, 314, 326 and 328 and the valve 310, connecting the guideways 286 and 298 behind the rams 282 and 294, respectively, with the interior passageway 280 below the level of the rams. A second fluid communication system comprises the fluid communication lines 316, 322, 324, 326 and 328 and the valve 320, connecting the guideways 286 and 298 behind the rams 282 and 294, respectively, with the interior passageway 280 above the level of the rams. Again, the first and second fluid communication systems share some fluid communication lines. The first and second fluid communication systems are operated to allow or block fluid flow therethrough by opening or closing their respective valves. Thus, the valve 310 provides first control apparatus for operating the first fluid communication system, and the valve 320 provides second control apparatus for operating the second fluid communication system.

To use the apparatus of FIG. 8 to seal a well against downhole fluid pressure, with the first fluid communication system open to communicate fluid pressure from down the well below the level of the rams 282 and 294 through the open valve 310 to the guideways 286 and 298 behind the rams 282 and 294, respectively, the second fluid communication system is closed by closing the valve 320, and the rams are moved to the closed configuration to seal the well around the well pipe (not shown) within the passageway 280. To use the apparatus of FIG. 8 in a pressure test of a higher blowout preventer or other apparatus, or to pressure-activate higher equipment, with the second fluid communication system open to communicate fluid pressure from the passageway above the level of the rams 282 and 294 through the open valve 320 to the guideways 286 and 298 behind the rams 282 and 294, respectively, the first fluid communication system is closed by closing the valve 310, and the rams are moved to the closed configuration to seal the well around the well pipe (not shown) within the passageway 330. Then, fluid pressure is introduced into the passageway 280 to test the closed blowout preventer or other apparatus under investigation, or to carry out any other high fluid pressure operation. In either use, the rams 332 and 344 are movable within the guideways 336 and 348, respectively, without resistance from a pressure differential.

Figure 9:
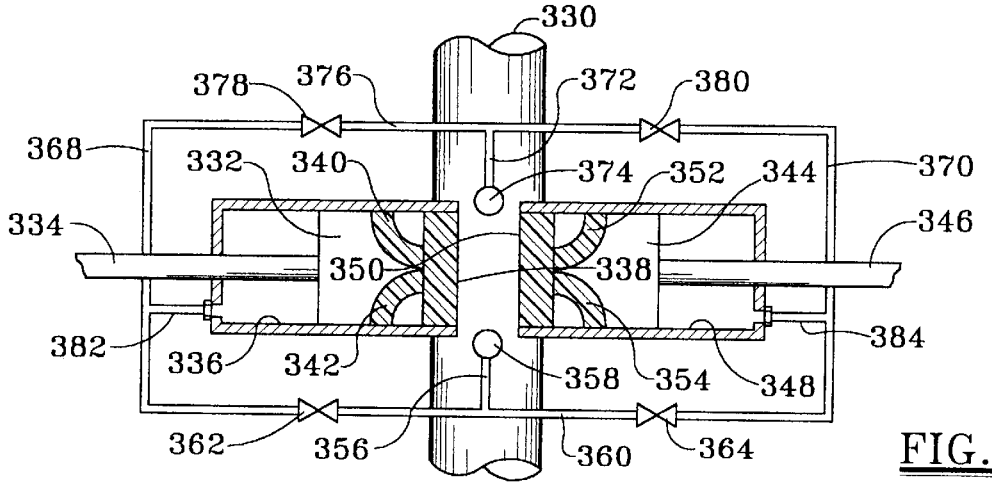
FIG. 9 is a view similar to FIGS. 7 and 8, but showing yet another version of fluid communication systems.

Yet another version of a fluid communication system for operation of bidirectional sealing rams according to the present invention is shown schematically in FIG. 9. A bidirectional sealing ram-type blowout preventer according to the present invention is positioned with a central vertical passageway 330 extending through the blowout preventer. A bidirectional sealing ram 332 is connected to a linear actuator by a rod 334 for movement within a guideway 336. The ram 332 carries a front packer 338, a top seal 340 and a bottom seal 342. A bidirectional sealing ram 344 is connected to a linear actuator by a rod 346 for movement within a guideway 348. The ram 344 carries a front packer 350, a top seal 352 and a bottom seal 354. The rams 332 and 344 seal the annulus around a pipe (not shown) within the passageway 330 and fit together, in the closed configuration.

A fluid communication line 356 connects between the interior of the passageway 330 by way of an access port 358, and a fluid communication line 360. The fluid communication line 360 joins the fluid communication line 356 to two valves 362 and 364. The other side of the valve 362 is connected to a fluid communication line 368, and the other side of the valve 364 is connected to a fluid communication line 370. A fluid communication line 372 connects between the interior of the passageway 330 by way of an access port 374, and a fluid communication line 376. The fluid communication line 376 joins the fluid communication line 372 to two valves 378 and 380. The other side of the valve 378 is connected to the fluid communication line 368, and the other side of the valve 380 is connected to the fluid communication line 370. A fluid communication line 382 connects the fluid communication line 368 to the interior of the guideway 336 behind the ram 332, and a fluid communication line 384 connects the fluid communication line 370 to the interior of the guideway 348 behind the ram 344. The access port 358 opens to the passageway 330 below the level of the rams 332 and 344, and the access port 374 opens to the passageway 330 above the level of the rams. A first fluid communication system comprises the fluid communication lines 356, 360, 368, 370, 382 and 384 and the valves 362 and 364, connecting the guideways 336 and 348 behind the rams 332 and 344, respectively, with the interior passageway 330 below the level of the rams. A second fluid communication system comprises the fluid communication lines 372, 376, 368, 370, 382 and 384 and the valves 378 and 380, connecting the guideways 336 and 348 behind the rams 332 and 344, respectively, with the interior passageway 330 above the level of the rams. The first and second fluid communication systems are operated to allow or block fluid flow therethrough by opening or closing their respective valves. Thus, the valves 362 and 364 provide first control apparatus for operating the first fluid communication system, and the valves 378 and 380 provide second control apparatus for operating the second fluid communication system. Again, the first and second fluid communication systems share some fluid communication lines.

To use the apparatus of FIG. 9 to seal a well against downhole fluid pressure, with the first fluid communication system open to communicate fluid pressure from down the well below the level of the rams 332 and 344 through the open valves 362 and 364 to the guideways 336 and 348 behind the rams 332 and 344, respectively, the second fluid communication system is closed by closing the valves 378 and 380, and the rams are moved to the closed configuration to seal the well around the well pipe (not shown) within the passageway 330. To use the apparatus of FIG. 9 in a pressure test of a higher blowout preventer or other apparatus, or to pressure-activate higher equipment, with the second fluid communication system open to communicate fluid pressure from the passageway above the level of the rams 332 and 344 through the open valves 378 and 380 to the guideways 336 and 348 behind the rams 332 and 344, respectively, the first fluid communication system is closed by closing the valves 362 and 364, and the rams are moved to the closed configuration to seal the well around the well pipe (not shown) within the passageway 330. Then, fluid pressure is introduced into the passageway 330 to test the closed blowout preventer or other apparatus under investigation, or to carry out any other high fluid pressure operation. In either use, the rams 332 and 344 are movable within the guideways 336 and 348, respectively, without resistance from a pressure differential.

Figure 10:
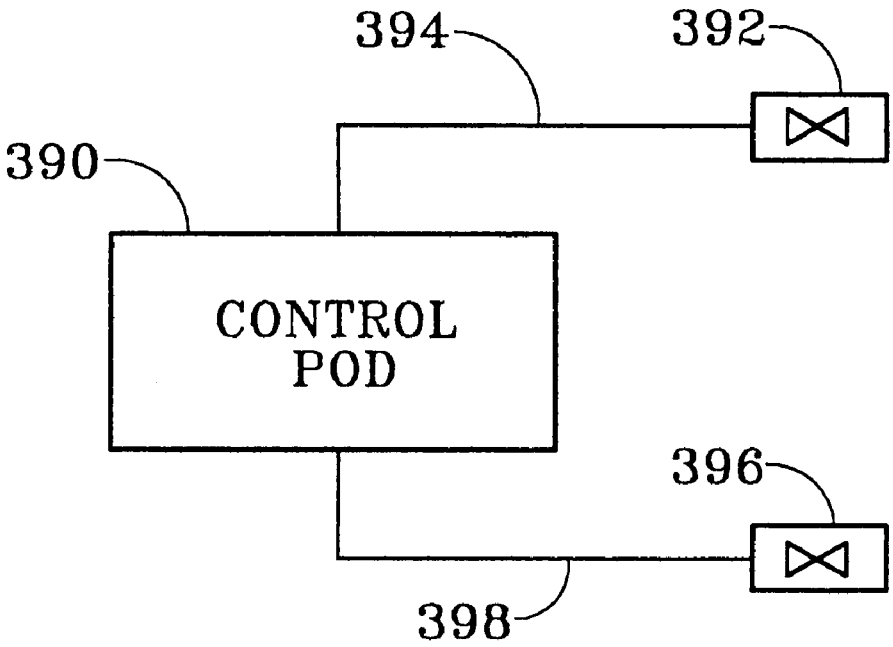
FIG. 10 is a schematic diagram illustrating a control unit connected to control apparatus of the fluid communication systems according to the present invention.

All of the fluid communication systems described above and illustrated in FIGS. 6–9 are operated by way of a control unit that may be located on the framework (not shown) of the blowout preventer stack. FIG. 10 shows a schematic of the operating system for the first and second fluid communication systems of the present invention, for instance, as shown in any of FIGS. 6–9. A control unit in the form of a control pod 390 is connected to first control apparatus 392 of a first fluid communication system by a suitable line 394, and to second control apparatus 396 of a second fluid communication system by a line 398. The first control apparatus 392 may be one or more valves of the first fluid communication system that are selectively opened or closed as discussed above. The second control apparatus 396 may be one or more valves of the second fluid communication system that are selectively opened or closed as discussed above. The nature of the lines 394 and 398 will be determined by whether the valves 392 and 394 themselves are operated electrically or by pneumatic or hydraulic pressure. The control pod 390 will also provide the appropriate electrical or fluid pressure signals to open or close the valves 392 and 396.

In the case of the fluid communication system of FIGS. 6 and 7, the first control apparatus 392 includes the valves 244 and 270 of the first fluid communication system, and the second control apparatus 396 includes the valves 252 and 278 of the second fluid communication system. In the case of the fluid communication system of FIG. 8, the first control apparatus 392 includes the valve 310 of the first fluid communication system, and the second control apparatus 396 includes the valve 320 of the second fluid communication system. In the case of the fluid communication system of FIG. 9, the first control apparatus 392 includes the valves 362 and 364 of the first fluid communication system, and the second control apparatus 396 includes the valves 378 and 380 of the second fluid communication system.

The control pod 390 generates signals to operate all of the valves in a multi-valve control apparatus simultaneously. Thus, the valves 244 and 270 in FIG. 7 are opened and closed together, and the valves 252 and 278 are opened and closed together. Likewise, the valves 362 and 364 in FIG. 9 are opened and closed together, and the valves 378 and 380 are opened and closed together.

Further, the first and second control apparatus 392 and 396, respectively, are interlocked through the control pod 390. That is, the control pod 390 generates its signals to operate the first and second controls simultaneously, and does so to insure that all of the valves of one of the first and second fluid communication systems are open while all of the valves of the other of the first and second fluid communication systems are closed. Thus, the control pod 390 opens all of the valves of one control apparatus 392 or 396 while simultaneously closing all of the valves of the other control apparatus. Consequently, fluid communication between the central passageway through the housing of a bidirectional ram-type sealing blowout preventer according to the present invention and the area behind the bidirectional sealing rams within their respective guideways will always be available.

The fluid communication system illustrated in FIG. 8 is preferred over the fluid communication systems shown in FIGS. 6/7 and 9 in view of the fact that each of the first and second fluid communication systems of FIG. 8 includes only one control valve 310 or 320 to operate the system, while each of the first and second fluid communication systems of FIGS. 6/7 and 9 includes two valves.

A bidirectional sealing ram as disclosed herein provides sealing with its guideways all the way around the body of the ram. Seals, or seal members, and packers utilized with the present invention may be made of plastic or any suitable elastomeric or other material. The first and second fluid communication systems may share components such as fluid communication lines. The fluid communication lines of the first and second fluid communication systems may be pipes, hoses or any other suitable conduits. The access ports to the central passageways used by the fluid communication systems may be located anywhere below the ram packers for the first fluid communication system and anywhere above the ram packers for the second fluid communication system. While an embodiment utilizing piston and cylinder assemblies to move the rams is illustrated and described herein, any method of linear actuation to close and open the rams may be used with the present invention.

Industrial Applicability

The present invention provides a bidirectional sealing ram-type blowout preventer that can be used in well control operations to seal a well around a well pipe against downhole pressure in well control, for example while drilling or completing a well with positive downhole pressure, as well as in preventing or shutting down a blowout, and can also be used to seal around a well pipe against pressure above to pressure test a blowout preventer higher in the blowout preventer stack without removing the well pipe from the well and inserting a test tool. Applications for the present invention include use as a blowout preventer as well as use in a blowout preventer stack for sealing wells and for pressure testing other blowout preventers in the stack. Applications for the present invention include such uses particularly in underwater blowout preventer stacks. Additional applications include testing or hydraulically activating various tools or completion apparatus within a blowout preventer stack above the bidirectional sealing ram-type blowout preventer of the present invention, in both surface installations and subsea installations.

What is claimed is:

1. A method of operating a bidirectional scaling ram-type blowout preventer, comprising: bidirectional sealing rams having top seals, bottom seals and front packers, operable by corresponding linear actuators for movement in corresponding guideways within a central housing to selectively seal the annulus around a pipe located within a central vertical passageway through the central housing, a selectively operable first fluid communication system between the central vertical passageway below the level of the ram packers and locations in the first and second guideways behind the rams, first control apparatus, comprising at least a first valve, for opening and closing the first fluid communication system, a selectively operable second fluid communication system between the central vertical passageway above the level of the ram packers and locations in the first and second guideways behind the rams, and second control apparatus, comprising at least a second valve, for opening and closing the second fluid communication system, having the steps of:

a. opening one and closing the other of the first and second fluid communication systems; and b. operating the linear actuators to selectively move the rams in the corresponding guideways.

2. A method of operating a bidirectional sealing ram-type blowout preventer as defined in claim 1 further comprising using a control unit connected to the first control apparatus and connected to the second control apparatus to selectively operate the first control apparatus and the second control apparatus to open and close the first and second fluid communication systems, respectively.

3. A method of operating a bidirectional sealing ram-type blowout preventer as defined in claim 1 comprising operating the bidirectional sealing ram-type blowout preventer to apply fluid pressure above the bidirectional sealing ram-type blowout preventer, comprising:

a. closing the first fluid communication system with the second fluid communication system open;

b. operating the linear actuators to move the rams to seal around a pipe in the central vertical passageway through the central housing; and c. applying fluid pressure within the vertical passageway above the packers of the rams of the bidirectional sealing ram-type blowout.

4. A method of operating a bidirectional sealing ram-type blowout preventer as defined in claim 3 wherein the pressure is applied within the vertical passageway to pressure test a blowout preventer, in its sealing configuration, positioned above the bidirectional sealing ram-type blowout preventer.

5. A method of operating a bidirectional sealing ram-type blowout preventer as defined in claim 1 comprising operating the bidirectional sealing ram-type blowout preventer to seal against fluid pressure from below, comprising:

a. closing the second fluid communication system with the first fluid communication system open; and b. operating the linear actuators to move the rams to seal around a pipe in the central vertical passageway through the central housing.

6. A bidirectional sealing ram-type blowout preventer comprising:

a. bidirectional sealing rams having top seals, bottom seals, and packers at the front of each ram;

b. a selectively operable first fluid communication system, comprising at least a first valve, for equalizing fluid pressure between the back of each ram with fluid pressure below the ram packers; and c. a selectively operable second fluid communication system comprising at least a second valve, for equalizing fluid pressure between the back of each tam with fluid pressure above the rain packers.

7. A ram-type blowout preventer fluid communication system comprising:

a. a selectively operable first fluid communication system for equalizing fluid pressure between the back of each ram of the blowout preventer with fluid pressure below the packers of the rams;

b. a selectively operable second fluid communication system for equalizing fluid pressure between the back of each ram of the blowout preventer with fluid pressure above the packers of the rams;

c. first control apparatus, comprising at least a first valve, for selectively opening and closing the first fluid communication system; and d. second control apparatus, comprising at least a second valve, for selectively opening and closing the second fluid communication system.

8. A ram-type blowout preventer fluid communication system as defined in claim 7 further comprising a control unit connected to the first control apparatus and connected to the second control apparatus whereby the first control apparatus and the second control apparatus may be selectively operated to open and close the first and second fluid communication systems, respectively.

9. A ram-type blowout preventer having a central housing with a cavity including first and second guideways extending radially outwardly in opposite directions from a central vertical passageway that extends through the central housing, and first and second linear actuators extending radially outwardly from the housing and aligned with the first and second guideways, respectively, comprising:

a. a first ram connected to the first linear actuator and movable within the first guideway;

b. the first ram including a ram body having a top, a bottom, a front end, a back end, a packer carried in a receptacle at the front end of the body, a top seal carried in a groove across the top of the body, a bottom seal carried in a groove across the bottom of the body, and being connected to the first linear actuator at the back end of the body;

c. a second ram connected to the second linear actuator and movable within the second guideway;

d. the second ram including a ram body having a top, a bottom, a front end, a back end, a packer carried in a receptacle at the front end of the body, a top seal carried in a groove across the top of the body, a bottom seal carried in a groove across the bottom of the body, and being connected to the second linear actuator at the back end of the body;

e. a first fluid communication system comprising fluid communication lines communicating between the central vertical passageway through at least one access port below the level of the ram packers and locations in the first and second guideways behind the rams;

f. first control apparatus, comprising at least a first valve, for selectively opening and closing the first fluid communication system;

g. a second fluid communication system comprising fluid communication lines communicating between the central vertical passageway through at least one access port above the level of the ram packers and locations in the first and second guideways behind the rams; and h. second control apparatus, comprising at least a second valve, for selectively opening and closing the second fluid communication system.

10. A ram-type blowout preventer as defined in claim 9 wherein at least one access port by which the second fluid communication system communicates with the central vertical passageway is located in the central housing of the blowout preventer.

11. A ram-type blowout preventer as defined in claim 9 wherein at least one access port by which the second fluid communication system communicates with the central vertical passageway is located in an extension of the central housing above the blowout preventer.

12. A ram-type blowout preventer as defined in claim 9 wherein at least one access port by which the second fluid communication system communicates with the central vertical passageway is located in the central housing of a second, higher blowout preventer.

13. A ram-type blowout preventer as defined in claim 9 wherein all of the access ports by which the first and second fluid communication systems communicate with the central vertical passageway are located in the central housing of the blowout preventer.

14. A ram-type blowout preventer as defined in claim 9 wherein:

a. the first linear actuator comprises a first piston and cylinder assembly; and b. the second linear actuator comprises a second piston and cylinder assembly.

15. A ram-type blowout preventer as defined in claim 9 further comprising a control unit connected to the first control apparatus and connected to the second control apparatus whereby the first control apparatus and the second control apparatus may be selectively operated to open and close the first and second fluid communication systems, respectively.

16. A ram-type blowout preventer having a central housing with a cavity including first and second guideways extending radially outwardly in opposite directions from a central vertical passageway that extends through the central housing, and first and second linear actuators extending radially outwardly from the housing and aligned with the first and second guideways, respectively, comprising:

a. a first ram connected to the first linear actuator and movable within the first guideway;

b. the first ram including a ram body having a top, a bottom, a front end, a back end, a packer carried in a receptacle at the front end of the body, a top seal carried in a groove across the top of the body, a bottom seal carried in a groove across the bottom of the body, and being connected to the first linear actuator at the back end of the body;

c. a second ram connected to the second linear actuator and movable within the second guideway;

d. the second ram including a ram body having a top, a bottom, a front end, a back end, a packer carried in a receptacle at the front end of the body, a top seal carried in a groove across the top of the body, a bottom seal carried in a groove across the bottom of the body, and being connected to the second linear actuator at the back end of the body;

e. a first fluid communication system comprising fluid communication lines communicating between the central vertical passageway through at least one access port below the level of the ram packers and locations in the first and second guideways behind the rams;

f. first control apparatus, comprising at least a first valve, for selectively opening and closing the first fluid communication system;

g. a second fluid communication system comprising fluid communication lines communicating between the central vertical passageway through at least one access port located in the central housing of another blowout preventer above the level of the ram packers and locations in the first and second guideways behind the rams; and h. second control apparatus, comprising at least a second valve, for selectively opening and closing the second fluid communication system.

17. A ram-type blowout preventer as defined in claim 16 wherein:

a. the first linear actuator comprises a first piston and cylinder assembly; and b. the second linear actuator comprises a second piston and cylinder assembly.

18. A ram-type blowout preventer as defined in claim 16 further comprising a control unit connected to the first control apparatus and connected to the second control apparatus whereby the first control apparatus and the second control apparatus may be selectively operated to open and close the first and second fluid communication systems, respectively.

* * * * *